United States Patent [19]

Matthews

[11] 4,084,599

[45] Apr. 18, 1978

[54] COLLAPSIBLE TEMPORARY OUTDOOR ENCLOSURE

[76] Inventor: Billy H. Matthews, 2659 Heritage Cir., Las Vegas, Nev. 89121

[21] Appl. No.: 743,866

[22] Filed: Nov. 22, 1976

[51] Int. Cl.[2] ..... A45F 1/16

[52] U.S. Cl. ..... 135/4 R; 135/DIG. 1

[58] Field of Search ..... 135/4 R, 4 A, DIG. 1

[56] References Cited

U.S. PATENT DOCUMENTS

| | | | |
|---|---|---|---|
| 2,159,309 | 5/1939 | Betourne | 135/4 R |
| 2,627,865 | 2/1953 | Mitchell et al. | 135/4 A |
| 3,036,583 | 5/1962 | Miller | 135/4 A |
| 3,161,231 | 12/1964 | Dawson et al. | 135/DIG. 1 X |
| 3,820,553 | 6/1974 | Huddle | 135/4 R |
| 3,906,968 | 9/1975 | Black | 135/4 R |

FOREIGN PATENT DOCUMENTS

| | | | |
|---|---|---|---|
| 981,293 | 1/1965 | United Kingdom | 135/4 A |
| 862,011 | 3/1961 | United Kingdom | 135/4 A |

*Primary Examiner*—Werner H. Schroeder
*Assistant Examiner*—Conrad L. Berman
*Attorney, Agent, or Firm*—Seiler & Quirk

[57] ABSTRACT

A collapsible overhead enclosure or shelter, especially for swimming pools or to serve as garages, storage sheds or the like. The enclosure consists of a pair of spaced base members and a plurality of shaped struts spanning between the base members mounted thereto at hinge points for swinging movement between a collapsed position and fan-like erected position. The hinge points are arranged in an arcuate pattern on each base member. A sheet of flexible material is supported by the struts and provides an overhead shelter or enclosure when the struts are in their fan-like erected positions. Alternate embodiments include the uppermost mounted strut being articulated at opposed locations so that it may lie flat on the ground when the struts are erected. Further alternate embodiments include reciprocal mounting for the base members whereby they may be moved to one location to collapse the shelter and to avoid interference with a swimming pool or other area.

In still another embodiment, a plurality of pairs of base members provide support for an elongated shelter, being movable from a first location in which the pairs of base members are spaced apart and the struts support an erected shelter to a second location with pairs of base members moved together and the struts stacked in a collapsed condition.

17 Claims, 11 Drawing Figures

COLLAPSIBLE TEMPORARY OUTDOOR ENCLOSURE

BACKGROUND AND SUMMARY OF THE INVENTION

This invention relates to collapsible overhead enclosures or shelter, and particularly to collapsible enclosures or shelters for swimming pools, or to serve as garages, airplane hangars, storage sheds, or the like.

Heretofore, enclosures have been provided for outdoor swimming pools to render them usable in cold weather. Attention has been directed to constructing enclosures for such purposes which are easy to erect and take down, and which are inexpensive to produce. To this end, a popular pool enclosure has been a flexible plastic shell supported by pumped air. A disadvantage has been that in colder environments the pumping of cold ambient air into the warm, moist pool region produces vapor and condensation which has been objectionable.

Likewise, such structures have not always been suitable to be partially opened, such as for access or ventilation, since an air seal is required to maintain them in an erect condition, unless support air is pumped in relatively large quantities at great rates.

The present invention provides a lightweight, economical collapsible enclosure structure particularly suitable for outdoor swimming pools but also suitable for numerous other enclosure or shelter purposes.

The present invention has the further advantage that it collapses into a compact, unobtrusive unit when not in use.

These and other objects and advantages of the present invention will be more readily apparent to persons of ordinary skill by reference to the following description, claims, and accompanying drawings.

DETAILED DESCRIPTION OF THE INVENTION

Figure 1:
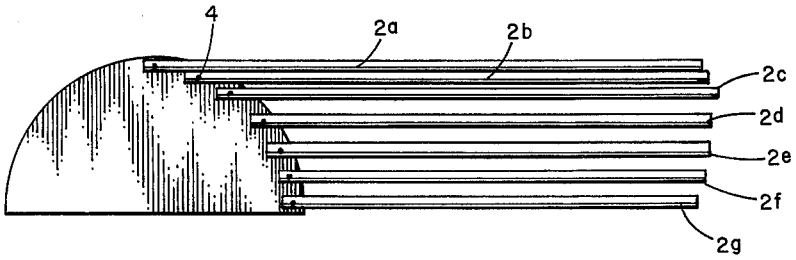
FIG. 1 is a side elevational schematic diagram of the enclosure of the present invention in its collapsed condition.
Figure 2:
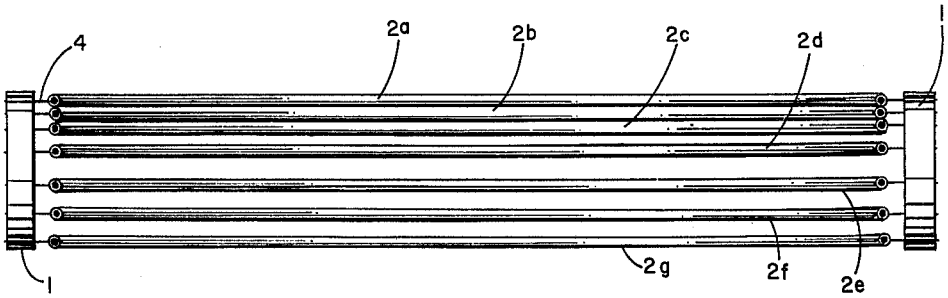
FIG. 2 is an end view of the device shown in FIG. 1.

FIGS. 1 and 2 depict the collapsible enclosure of the present invention in its collapsed condition. The device is comprised of a pair of opposed base members 1 and a plurality of arched struts 2*a* through 2*g* spanning between them. Each of the struts 2*a* through 2*g* are mounted at their ends for swinging movement at hinge points 4. The hinge points may comprise pins, rod or bolts extending through one of the base members and each strut, adjacent its end with the rod ends being flared or flanged or having nuts threadedly engaged on the bolt ends for holding the struts in position. The hinge points 4 are arranged in an arcuate configuration commencing vertically upward at the foot of the base member 1 and curving upward and sideways to describe an arc of approximately 90°. A flexible sheet 3 is stretched across the struts 2*a* through 2*g* to form a generally hemispherical shell.

Figure 3:
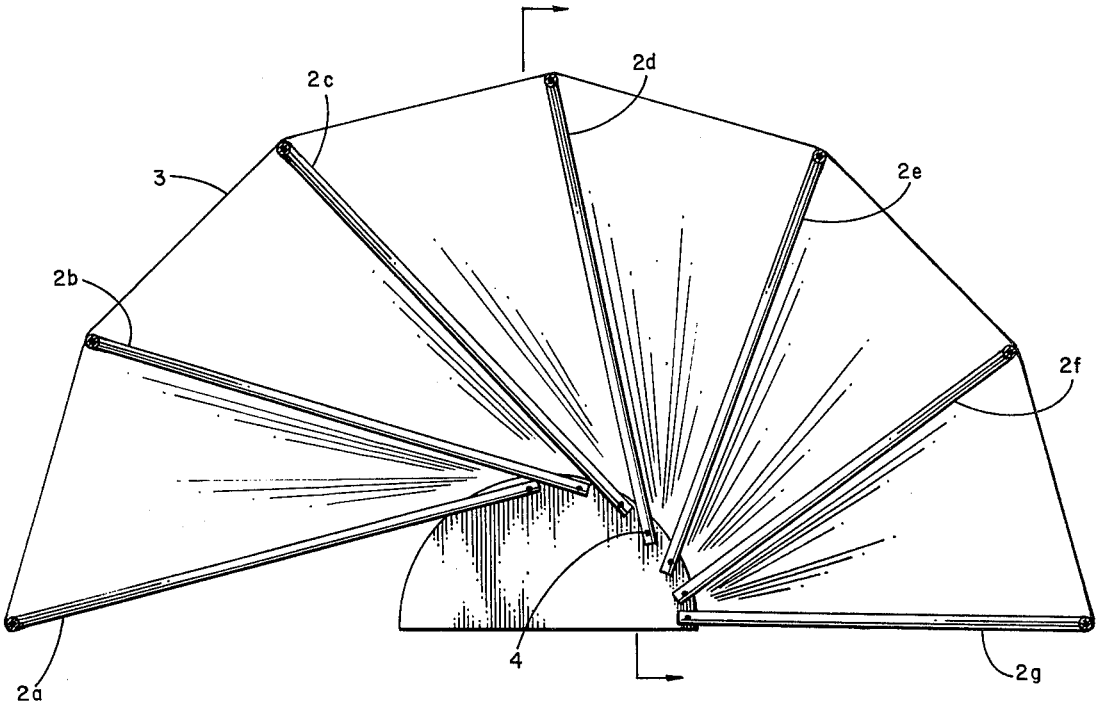
FIG. 3 is a side elevational schematic diagram of the device of FIG. 1 in its erect condition.

In operation, the device is in its collapsed condition when, as shown in FIGS. 1 and 2, the struts 2*a–g* lie to the right hand side of the arcuately disposed hinge points 4, i.e., when the struts 2*a–*2*g* lie substantially parallel to the ground on that side of the base member where the lowest mounted strut 2*g* is located. To erect the structure, the uppermost strut 2*a* is swung in a direction away from the other struts (toward the left hand side of the diagram) until it engages the ground on the opposite (left hand) side of the base member. The flexible sheet 3 draws the remainder of the struts in the same direction. The sides of the struts are attached at fixed locations evenly spaced along the flexible sheet 3 so that they support the sheet at relatively evenly spaced locations and when fully erected automatically assume a generally symetric fan-like configuration as best illustrated in FIG. 3. When the structure is to be collapsed to the condition shown in FIGS. 1 and 2, by pulling downwardly on strut 2*f* until it rests on strut 2*g*, 2*e* is automatically pulled downwardly and the remaining struts are advanced toward the collapsed condition. This operation is repeated until strut 2*a* passes through approximately the vertical plane when all the remaining erected struts will be pulled by their own weight to the fully collapsed position.

It will be appreciated that if the hinge points 4 were arranged in a straight line, the struts would interfere with one another in either the fully erect or fully closed position and would, in fact, prevent the structure from assuming one or the other of such positions.

Figure 4:
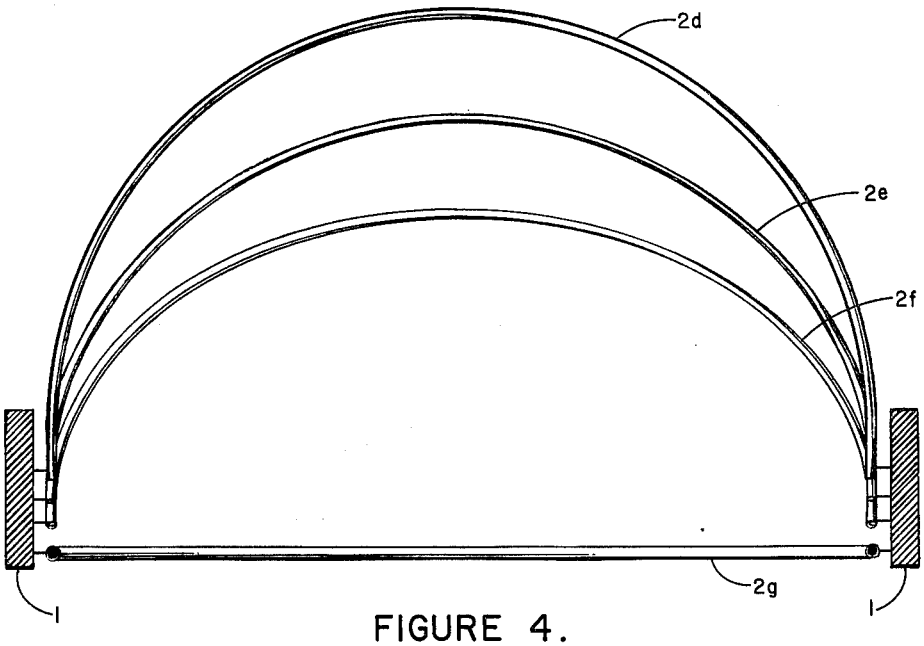
FIG. 4 is an end sectional elevation of the device illustrated in FIG. 3, taken along the lines 4—4 thereof.
Figure 5A:
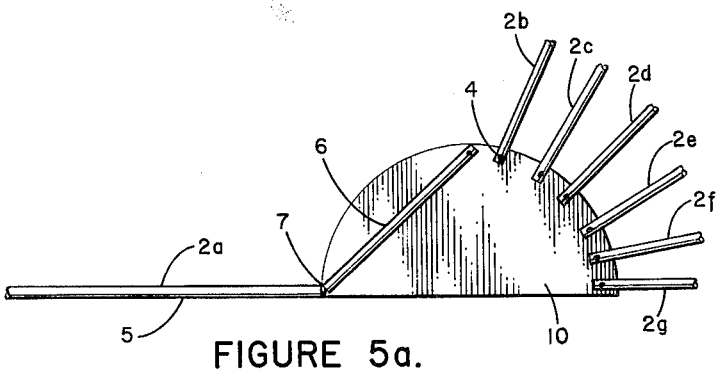
FIG. 5*a* is a side elevational view of a second embodiment of the device illustrated in FIGS. 1–4 wherein the lead strut is articulated to lie flat on the ground.
Figure 5B:
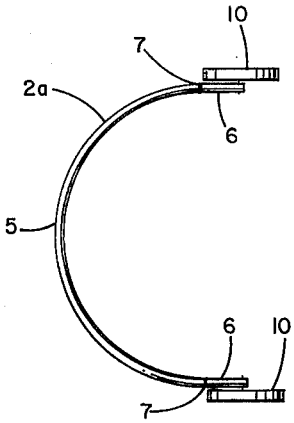
FIG. 5*b* is a plan sectional view showing an articulated strut of the device of 5*a;*
Figure 6:
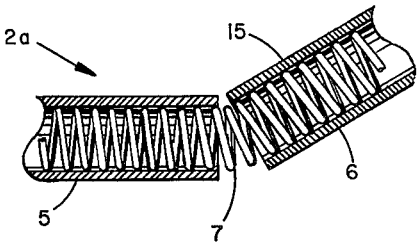
FIG. 6 is a sectional elevational view of a spring articulation suited for use in the lead strut of FIGS. 5*a* and 5*b;*

Referring to FIGS. 5*a* and 5*b*, there is shown another embodiment in which a plurality of curved struts 2*a–*2*g* are mounted at arcuately arranged hinge points 4 on a pair of opposite base members 10. The device is very much like the device shown in FIGS. 1–4 except that the lead or uppermost strut 2*a* consists of first and second sections 5 and 6, respectively, which are angled with respect to one another and joined adjacent ends by a hinge 7. The strut 2*a* is thus articulated enabling first section 5, the section located furthest from the hinge point 4, to lie flat against the ground, rather than at an angle as in the case of strut 2*a* in FIG. 3. The two second sections 6 are each joined to one of the bases 10 and joined to opposed ends of the first section 5. The hinge 7 may be constructed in any desired fashion, for example, a hinge or pivot pin extending through overlapping ends of strut sections 5 and 6, or other articulating means may be used. For example, a spring articulation 4, illustrated in FIG. 6, is biased toward maintaining strut sections 5 and 6 in end-to-end parallel alignment and has the advantages of low cost and tends to assure that the top mounted strut 2*a* will lie flat against strut 2*b* when the device is collapsed. It also assures that strut 2*a* will readily flex to permit the section 5 to lie flat against the ground when the device is fully erect. In FIG. 6, the first and second sections 5 and 6 are articulated at 7 and consist of hollow tubes joined end to end by an interior mounted helical spring 15. Alternatively, the strut 2*a* may be provided with a rigid bend, rather than an articulation, although special configurations would be required if the strut 2*a* were to lie neatly with the other struts 2*b*–2*g* when the assembly is in its collapsed state. Whether or not an articulated end strut is used will depend on the undesirability of having a vent space between the ground and strut 2*a* of FIG. 3. If full closure is important, then the articulated strut embodiment will be preferred.

Figure 7:
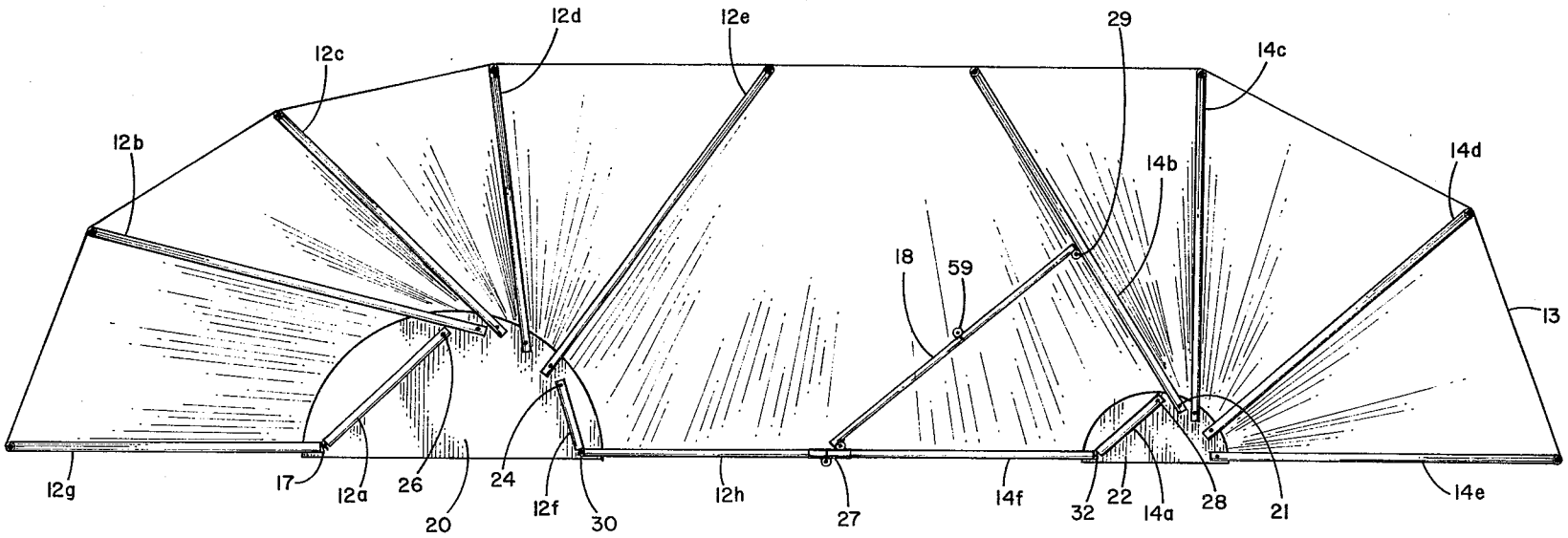
FIG. 7 is a side sectional elevation of another embodiment illustrating the use of two pairs of spaced base members to form an elongated erected structure.

Referring now to FIG. 7, there is shown another embodiment of the invention in which a plurality of pairs of base members 20 and 22 are utilized and arranged to create an elongated shelter or structure. Since the structure shown is a side view, it will be understood that only one member 20 and 22, respectively, of each pair of base members are seen or viewed. Base member 22 of a first pair of base members has attached thereto a plurality of struts 14*a*–14*e* very similar to the arrangement shown in FIG. 5*a*. Strut 14*e* located at the lowest end of the arcuate strut hinge pattern lies substantially horizontal and on the ground or other surface on which base member 22 is supported. Strut 14*a* hinged at the uppermost or highest point 28 in the arcuate hinge pattern on base member 22 is articulated at hinge or pivot point 32. Again, this may be a hinge as shown in FIG. 6, or may be an unbiased hinge, using mating washers or knuckles joined on a common pivot or hinge pin. Alternatively, strut 14*a* may instead be bent at the pivot point area as previously described. It will be appreciated that there is another substantially identical strut opposite strut 14*a* on an opposite base member of the pair not shown, and both of these struts have a second strut portion 14*f* extending outwardly and secured at hinge connection 27. In other words, struts 14*b*–14*e* have a bowed or arc shape similar to the struts shown in FIG. 4 while strut 14*a* and strut section 14*f* are simply straight, elongated and connected at common hinge 32. The end of strut section 14*f* opposite the hinge is secured at connection 27 as will be explained hereinafter.

A second pair of base members 20 are also provided with a plurality of struts 12*a*–12*f*, with struts 12*b*–12*e* being arc-shaped as in FIG. 4. Strut section 12*g* corresponds to bowed section 5 in FIG. 5*b* and is connected to two strut sections 12*a* at articulating or pivot point 17, again like that explained regarding FIG. 5*b*. Strut 12*f* is similar to strut 14*a*, commonly hinged to straight strut section 12*h*, corresponding to strut section 14*f* and also secured at the opposite end in connection 27. Of course there are also opposite sections 12*f* and 12*h*, not shown.

Figure 10:
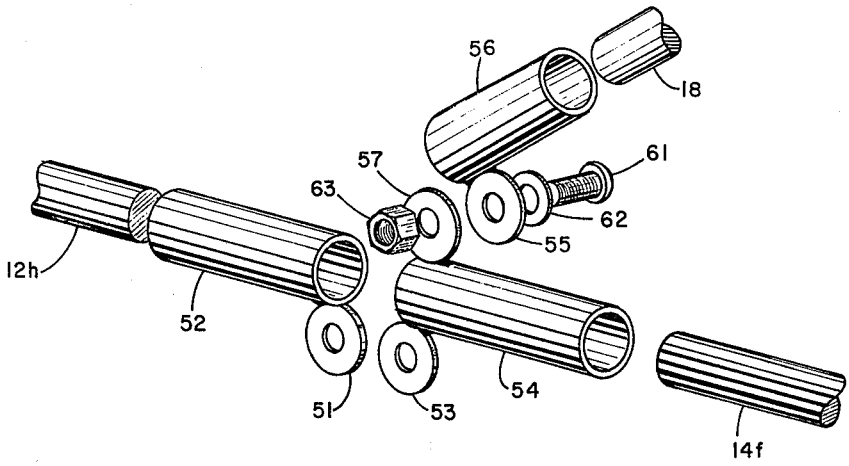
FIG. 10 is an enlarged view showing a hinge and joint means for connecting certain struts.

A preferred embodiment of connection 27 is illustrated in detail in FIG. 10. As shown, a pair of hollow sleeves 52 and 54 are used in which the ends of strut sections 12*h* and 14*f*, respectively, are secured while the lower end of support rod 18 is secured in sleeve 56. The sleeves are preferably hinged for pivotal engagement on the member. This feature is provided by hinge ears 51 and 55 secured to sleeves 52 and 56, respectively, while sleeve 54 is provided with two ears, 53 and 57. The hinged connection is made by mating hinge ears 51 and 53 together and similarly mating hinge ears 55 and 57. This may be accomplished using two bolts 61, nut 63 and washer 62, which bolts extends through each pair of mated ears. Other equivalent means for pivotally connecting the ends of these struts may also be used. For example, hollow sleeves are not necessary and the ears may be secured directly onto the strut ends to achieve the same purpose.

Hinged connection 29 may comprise the same features of connection 27 shown in FIG. 10 and described above for securing the upper end of support rod 18. Thus, a hinge ear is attached along strut 14*b* and is mated with a hinge ear at the upper end of support rod 18. In the erected position shown in FIG. 7, support rod 18 extending between hinged connections 27 and 29 will force the connection 27 downwardly and prevent it from buckling. With strut sections 12*h* and 14*f* forced downwardly, the cover attached thereto is maintained taut as desired. It will also be understood that there are identical connections 27 and 29 on the opposite side of the apparatus as well as another support rod 18.

Figure 8:
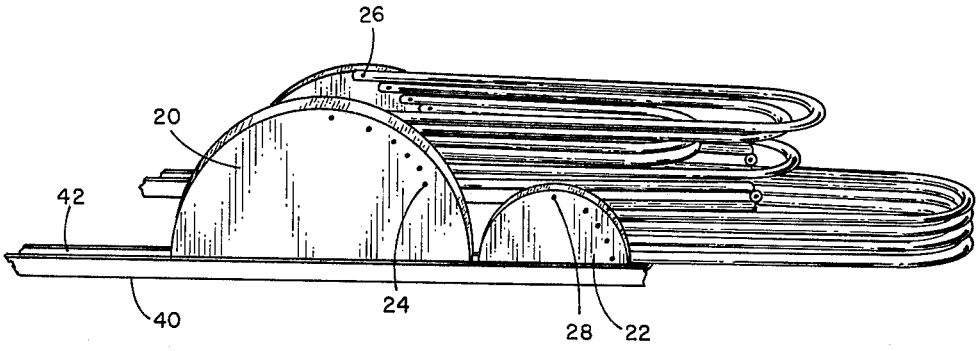
FIG. 8 is a side view of the base members and struts of FIG. 7 in a collapsed condition also illustrating a track for moving the base members.

The relative height of the two base members 20 and 22 is important in this multiple base member embodiment in order to collapse the structure in a nesting or stacking manner shown in FIG. 8. Accordingly, for this purpose, it is necessary that hinge point 24, where strut 12*f* is connected to base member 20 must be elevated to at least the elevation of hinge point 28, where strut 14*a* is connected on base member 22. Preferably, hinge point 24 is slightly elevated above hinge point 28, that difference in elevation being the approximate thickness or cross-section of struts 12*f* and 14*a*. The importance of this feature is understood in considering the collapsible nature of the structure. When it is desired to collapse the structure from that shown in FIG. 7 to that shown in FIG. 8, the lower end of support rod is disconnected from connection 27, as are the ends of strut sections 14*f* and 12*h*. Alternatively, rod 18 may incorporate a hinge 59 so that the end of the rod need not be disconnected and the rod will simply fold up between struts 14*a* and 14*b*. Such a hinge 59 also preferably includes means for locking it in the position shown and unlocking it for collapsing the structure. Of course, folding or disconnection of the rods is required on both sides of the structure. With that accomplished, as the operator begins to collapse the device to the right, struts 14*b*–14*d* are stacked on strut 14*e* which is lying on the ground or other supporting surface in a manner previously described regarding FIGS. 1–4. Since the struts are attached to sheet 3, once stacking begins, all of the struts are pulled toward a collapsed condition. As strut 14*b* begins to move to the right and passes through a vertical plane, supporting rod 18 will also be pulled along via hinge 29 and thus, also be stacked on strut 14*b*. For this reason, it is also desirable for the length of rod 18 to be the same length as the distance from hinge 29 to hinge 21, so that the rod will stack on strut 14*b*. It is also preferred that the total length of strut portions 14*a* and 14*f*, i.e., the distance between connection 27 and hinge 28, twice the length of rod 18 or the distance between hinge 29 and hinge 21. However, specific strut lengths are not so important so long as the cover or shell is properly supported and is reasonably taut or without folds or pleats when in the erected position. Again, during collapse, strut 14*a* must be elevated from its rest position through an arc pattern until it abuts strut 14*b* and finally rests on the stack of struts as illustrated in FIG. 8. As strut section 14*f* is elevated, section 12*h* will be pulled toward base member 22 as the ends of these sections pivot at connection 27. At the same time, base member 20 and the struts thereof will be urged to the right. The pair of base members 20 is then moved to the right. The pair of base members 20 is then moved to the right adjacent the pair of base members 22 with strut 12*g* and strut section 12*h* elevated so as to overlie and rest upon strut 14*b*. Thereafter, the remaining struts are stacked to achieve a collapsed condition illustrated in FIG. 8.

Preferably, a track 40 is incorporated with the structure so that the base members can be relatively easily reciprocally moved between an erected position (FIG. 7) and a collapsed condition (FIG. 8), with the base members being slidably engaged in a slot 42. Wheels, rollers and the like may be utilized to assist in the ease with which the base members are moved along the tracks to a desired location in an erected position and then to the end of the track as illustrated in FIG. 8 in the collapsed condition for storage out of the way of the pool or other area. Pulleys, power units, springs and the like may be used in assisting in assembly of the structure, particularly in the multiple base pair embodiments, where the enclosure is relatively large. For example, a spring or other biasing means may be secured between base member 22 and a suitable position for urging the base member to the right as FIG. 8 is viewed. Further, a pulley or other means for driving base members 20 and 22 to the left may also be incorporated, whereby movement to an erected condition is assisted. This assistance may also be used in the single base member pair embodiment previously described, especially advantageous in combination with a track.

Although the embodiment shown in FIG. 7 uses only two pairs of base members, additional pairs of base members and struts may also be used to further extend the structure to any practical limit desired. However, in order for a collapsed condition illustrated in FIG. 8 with the struts lying in a nesting relationship on top of one another, each of the successive pair of base members will have to be enlarged so that the lowest strut hinge point of the next successive pair of base members is elevated to at least the height of the highest hinge point of the adjacent preceding base member. With such a design or arrangement of components utilizing connecting members along the interior struts as shown, such a structure having any desired length may be constructed as will be appreciated by those skilled in the art. However, without such a feature, the struts of successive base member pairs could not be stacked as shown in FIG. 8. Moreover, each strut hinge point along the arcuate pattern on any base member must be elevated from the adjacent hinge the thickness of the strut, the elevation measured vertically. As previously mentioned, this is necessary for achieving horizontal stacking of struts.

Figure 9:
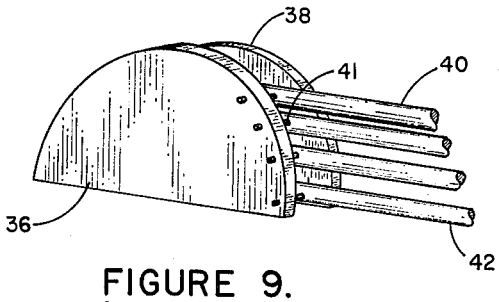
FIG. 9 is a perspective view showing another base member embodiment.

FIG. 9 illustrates an alternative embodiment of base members in which a pair of base members sides 36 and 38 are provided with rods 41 extending to each of the base member sides and to which rods or hinge pins the struts are pivotally secured. Stops may be placed between the plates for limiting further pivotal movement of the struts when it has moved to its proper position as well as providing support in that position. Moreover, instead of the struts being directly secured to the pivots and base members as previously described, a plurality of hollow tubes or pipes 40 may be used of any suitable length, each having an opening 42 into which the struts may be placed and secured. The interior of the pipes may be tapered as may be the strut ends for frictional engagement and securing, while also providing for strut removal. In this manner, the structural components may be significantly disassembled and stored in a collapsed condition or more easily moved to a new location.

The base plates of the above embodiments may be constructed of any durable rigid material. Steel is preferred. The struts are of any strong lightweight material, preferably flexible. Fiberglass tubing is preferred for this purpose. The sheet is preferably rip-stop nylon or PVC and may be mounted on the struts in a variety of ways, as by loops, snaps or various other conventional means well known in the tent and awning trade. However, sewn or snapped tubular hems are preferred, through which the struts are slid endwise. These as well as other modifications within the purview of the invention will be evident to those skilled in the art.

I claim:

1. A collapsible shelter comprising:

a pair of spaced base members;

a plurality of shaped struts spanning between said base members, said struts mounted at hinge points on said base members for swinging movement between a collapsed position and an erected position, said hinge points arranged in an arcuate pattern on each base member along a line extending from adjacent the bottom edge of said base member upward and curving through an arc of approximately 90°;

a sheet of flexible material supported on said plurality of shaped struts, so that when said struts are in said collapsed position all of said struts lie horizontally on top of one another and generally parallel to one another with the sheet folded therewith, and when said struts are in said erected position they assume a fan-like relationship, extending radially outward from said base members, and said sheet is stretched across said struts to provide a shelter in accordance with the shapes of said struts.

2. The collapsible shelter of claim 1 wherein the one of said struts mounted at the top of said arcuate pattern of hinge points has an angled section to lie flat on the ground or other surface supporting said base members.

3. The collapsible shelter of claim 1 wherein the one of said struts mounted at the top of said arcuate pattern of hinge points is articulated to lie flat on the ground or other surface supporting said base members.

4. The collapsible shelter of claim 1 wherein the one of said struts mounted at the top of said arcuate pattern of hinge points has first and second segments, said first segments extending between said hinge points and said second segment, said second segment angled relative to said first segment for lying flat on the ground or other surface supporting said base members.

5. The collapsible shelter of claim 1 further including a pair of spaced parallel tracks for mounting said spaced pair of base members for reciprocal movement between first and second locations.

6. The collapsible shelter of claim 4 wherein first segments are joined to said second segment by means for articulation of said second segment relative to said first segments.

7. The collapsible shelter of claim 6 wherein said articulation means comprises a spring generally biasing said second segment to lie in the same plane as said first segments.

8. The collapsible shelter of claim 5 wherein when said struts are in said erected positions at said first location, said second location is spaced from said first location in the direction at which the strut mounted at the lowermost hinge point extends.

9. The collapsible shelter of claim 8 further comprising means for moving said base members between said first and second locations.

10. The collapsible shelter of claim 9 wherein said moving means comprises means biasing said base members toward said second location and means for driving said base members from said second location to said first location against the urging of said biasing means.

11. A collapsible shelter comprising:

a plurality of opposite pairs of spaced base members;

a plurality of shaped struts spanning between opposite pairs of base members, said struts mounted at hinge points on said base members for swinging movement between a collapsed position and an erected position, said hinge points arranged in an arcuate pattern on each base member wherein the arcuate pattern of successive pairs of base members is elevated whereby the lowest hinge point of a second pair of base members is elevated above the highest hinge point of a first pair of said base members and so on whereby said collapsed position is characterized by said struts lying horizontally on top of one another and generally parallel to one another;

a sheet of flexible material supported on said plurality of shaped struts, so that when said struts are in said collapsed position, said sheet folds therewith, and when said struts are in said erected positions, said sheet is stretched across said struts to provide a shelter in accordance with the shapes of said structs.

12. The collapsible shelter of claim 11 wherein said hinge points on a first pair of said base members lie generally along a line extending from adjacent the bottom edge of said base member upward and curving through an arc of approximately 90°.

13. The shelter of claim 12 wherein the one of said struts mounted at the highest end of said arc line of hinge points of said first pair of base members and the ones of said struts mounted at the lowest and highest end of said arc line of hinge points of said second and successive pairs of base members are articulated to lie flat on the ground or other surface supporting said base members.

14. The collapsible shelter of claim 12 wherein the one of said struts mounted at the highest end of said arc line of hinge points of said first pair of base members and the ones of said struts mounted at the lowest and highest end of said arc line of hinge points of said second and successive pairs of base members has first and second segments, said first segments extending between said hinge points and said second segment, said second segment angled relative to said first segment for lying flat on the ground or other surface supporting said base members.

15. The collapsible shelter of claim 12 wherein first segments are joined to said second segment by means for articulation of said second segment relative to said first segments.

16. The collapsible shelter of claim 12 further including a pair of spaced parallel tracks for mounting said spaced pairs of base members for reciprocal movement between first and second locations.

17. The collapsible shelter of claim 16 wherein when said struts are in said erected positions at said first location, said second location is spaced from said first location in the direction at which the strut mounted at the lowermost hinge point extends.

* * * * *